United States Patent [19]

Bauer et al.

[11] 4,345,369

[45] Aug. 24, 1982

[54] CONTROL UNIT AND ELECTRICAL SWITCH CONSTRUCTION THEREFOR—METHODS OF MAKING SUCH A CONTROL UNIT AND ELECTRICAL SWITCH CONSTRUCTION

[75] Inventors: Werner R. Bauer, Radnor; William N. Smith, Hatboro, both of Pa.

[73] Assignee: Robertshaw Controls Company, Richmond, Va.

[21] Appl. No.: 271,527

[22] Filed: Jun. 8, 1981

Related U.S. Application Data

[60] Division of Ser. No. 120,259, Feb. 11, 1980, Pat. No. 4,314,122, which is a division of Ser. No. 766,018, Feb. 7, 1977, Pat. No. 4,245,142, which is a continuation-in-part of Ser. No. 707,635, Jul. 22, 1976.

[51] Int. Cl.[3] ..... H01H 11/00

[52] U.S. Cl. ..... 29/622; 29/613

[58] Field of Search ..... 29/613, 622; 200/83 S, 200/83 R, 83 SA, 67 E, 67 DA, 249, 286, 153 T, 153 V, 330, 332

[56] References Cited

U.S. PATENT DOCUMENTS

| | | | |
|---|---|---|---|
| 2,556,519 | 6/1951 | Bowor | 200/83 SA |
| 2,821,588 | 1/1958 | Fisher | 200/67 E |
| 3,153,715 | 10/1964 | Weisgerber | 200/83 SA |
| 3,182,150 | 5/1965 | Smith | 200/83 SA |
| 3,233,055 | 2/1966 | Russell | 200/67 DA |
| 3,911,238 | 10/1975 | Otto et al. | 200/286 |
| 3,952,611 | 4/1976 | Cumming | 200/83 R |

*Primary Examiner*—Leon Gilden

*Attorney, Agent, or Firm*—Candor, Candor & Tassone

[57] ABSTRACT

A control unit having a condition selector, an electrical switch having an actuator unit provided with an adjustable movement differential, a condition responsive device for actuating the switch when the condition responsive device senses certain conditions selected by the selector, and a lever arrangement carried by the unit and being operatively associated with the actuator unit of the switch and the device whereby the device can actuate the switch by the lever arrangement, the lever arrangement having a first adjustable lever operatively interconnected to the selector and acting as a main range lever. The first lever is operatively interconnected to the condition responsive device and to the actuator unit of the switch. The lever arrangement has a second adjustable lever operatively interconnected to the selector and to the actuator unit of the switch for adjusting the movement differential of the actuator unit of the switch.

3 Claims, 14 Drawing Figures

CONTROL UNIT AND ELECTRICAL SWITCH CONSTRUCTION THEREFOR—METHODS OF MAKING SUCH A CONTROL UNIT AND ELECTRICAL SWITCH CONSTRUCTION

This application is a divisional patent application of its copending parent patent application, Ser. No. 120,259, filed Feb. 11, 1980, now U.S. Pat. No. 4,314,122 which, in turn, is a divisional patent application of its copending parent patent application, Ser. No. 766,018, filed Feb. 7, 1977, now U.S. Pat. No. 4,245,142 which is a continuation-in-part of Ser. No. 707,635 filed Jul. 22, 1976.

This invention relates to an improved condition responsive control unit and to an electrical switch construction therefor as well as to methods of making such a control unit and such an electrical switch construction.

It is well known to provide a control unit having a condition selector means, an electrical switch, a condition responsive device for actuating the switch when the condition responsive device senses certain conditions selected by the selector means and lever means carried by the unit and being operatively associated with the switch and the device whereby the device can actuate the switch by the lever means, the control unit having means for adjusting the differential in the operation of the switch for such a unit or the like. For example, see the U.S. Patent to Cumming, U.S. Pat. No. 3,952,611 which is assigned to the same assignee to whom this application is assigned.

It is a feature of this invention to provide improved means for adjusting the differential in the operation of the switch of such a control unit.

In particular, in the control unit of the aforementioned U.S. Pat. No. 3,952,611, the cut-out temperature was selected by the selector means and then the temperature differential (either positive or negative) was set by the selector means. However, in the control unit of this invention, both the cut-out temperature and the cut-in temperature can be set independently of each other.

For example, one embodiment of this invention provides a control unit having a condition selector means, an electrical switch having an actuator means provided with an adjustable movement differential, a condition responsive device for actuating the switch when the condition responsive device senses certain conditions selected by the selector means, and lever means carried by the unit and being operatively associated with the actuator means of the switch and the device whereby the device can actuate the switch by the lever means, the lever means having a first adjustable lever operatively interconnected to the selector means and acting as a main range lever. The first lever is operatively interconnected to the condition responsive device and to the actuator means of the switch. The lever means has a second adjustable lever operatively interconnected to the selector means and to the actuator means of the switch for adjusting the movement differential of the actuator means of the switch.

The electrical switch construction of this invention for such a unit has an actuator means provided with adjustable means for adjusting the movement differential of the actuator means without adjusting the air gap between the contact stops for the switch blade of the switch, the selector means being operatively associated with the adjustable means through the lever means to selectively adjust the movement differential of the switch.

Accordingly, it is an object of this invention to provide an improved control unit having one or more of the novel features of this invention as set forth above or hereinafter shown or described.

Another object of this invention is to provide a method of making such a control unit, the method of this invention having one or more of the novel features of this invention as set forth above or hereinafter shown or described.

Another object of this invention is to provide an improved electrical switch construction, the electrical switch construction of this invention having one or more of the novel features of this invention as set forth above or hereinafter shown or described.

Another object of this invention is to provide an improved method of making such an electrical switch construction, the method of this invention havine one or more of the novel features of this invention as set forth above or hereinafter shown or described.

Other objects, uses and advantages of this invention are apparent from a reading of this description which proceeds with reference to the accompanying drawings forcing a part thereof and wherein.

Figure 1:
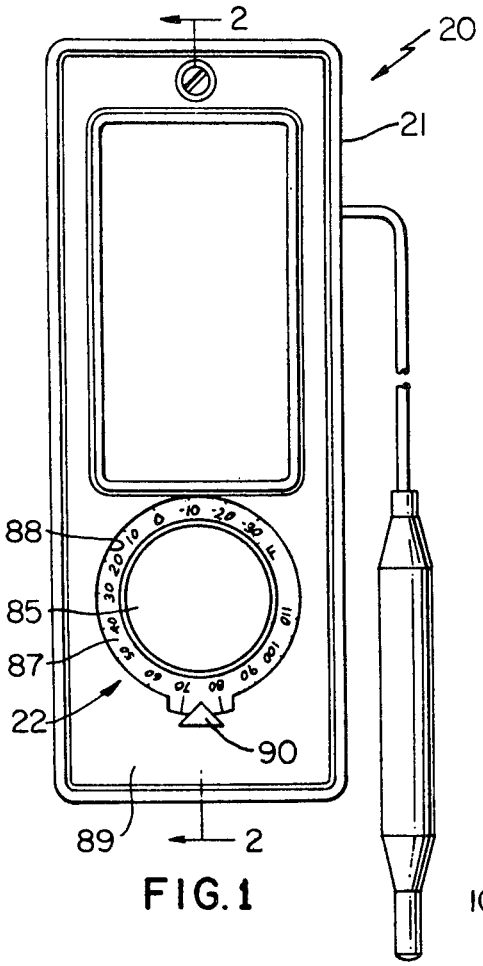
FIG. 1 is a front view of the improved control unit of this invention.

While the various features of this invention are hereinafter described and illustrated as being particularly adapted to provide for a control unit that is temperature responsive, it is to be understood that the various features of this invention can be utilized singly or in any combination thereof to provide a control that is responsive to other conditions as desired.

Therefore, this invention is not to be limited to only the embodiments illustrated in the drawings, because the drawings are merely utilized to illustrate one of the wide variety of uses of this invention.

Figure 2:
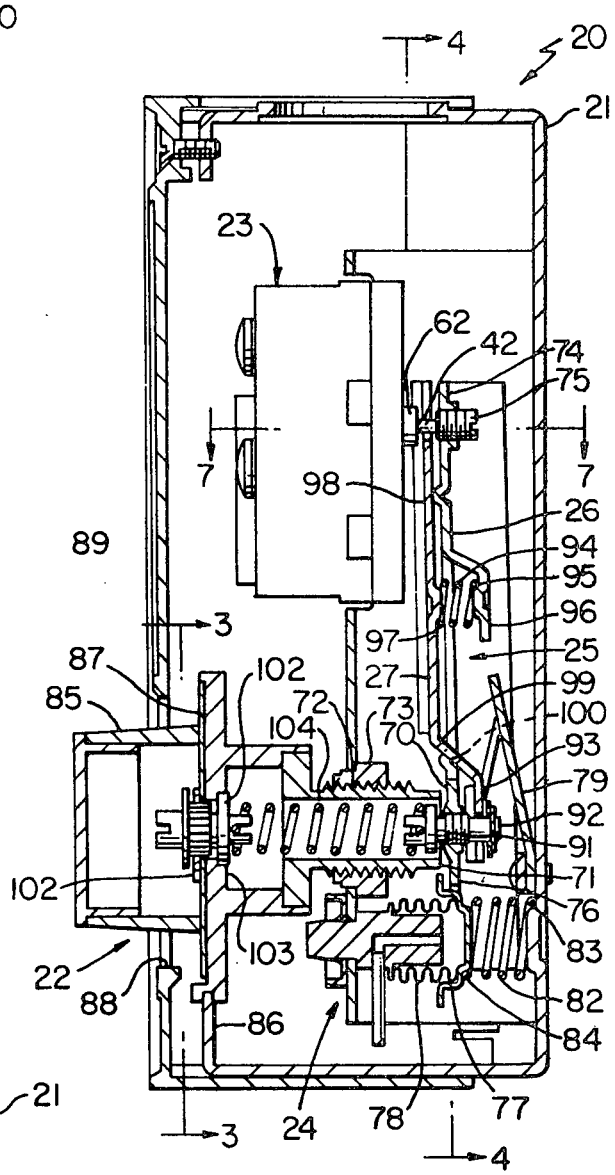
FIG. 2 is an enlarged cross-sectional view taken on line 2—2 of FIG. 1.
Figure 3:
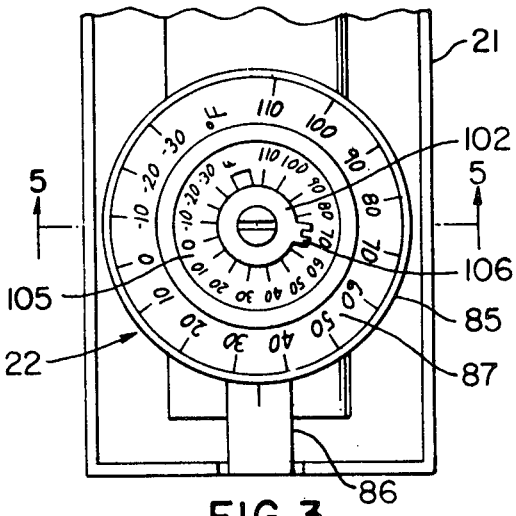
FIG. 3 is a fragmentary cross-sectional view taken on line 3—3 of FIG. 2.
Figure 5:
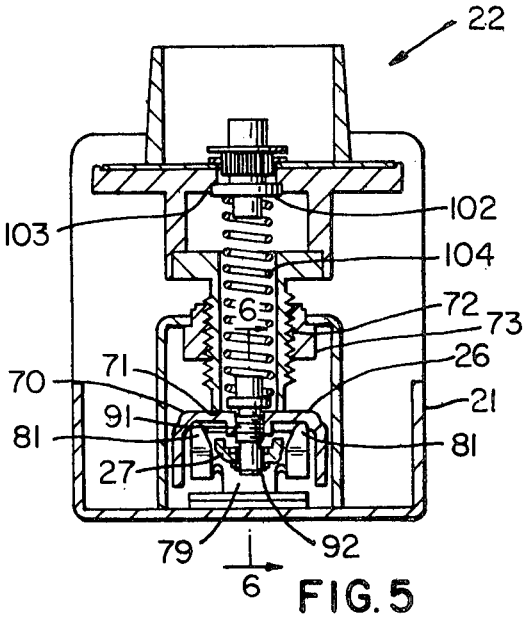
FIG. 5 is a cross-sectional view taken on line 5—5 of FIG. 3.

Referring now to FIGS. 1, 2 and 3, the improved control unit of this invention is generally indicated by the reference numeral 20 and comprises a housing means 21 having a condition selector means that is generally indicated by the reference numeral 22, an electrical switch construction that is generally indicated by the reference numeral 23, a condition responsive device that is generally indicated by the reference numeral 24 for actuating the switch construction 23 when the condition responsive device 24 senses certain conditions selected by the selector means 22, and lever means generally indicated by the reference numeral 25 and being carried by the housing means 21 in a manner to be operatively associated with the electrical switch construction 23 and the condition responsive device 24 whereby the condition responsive device 24 can actuate the switch construction 23 by the lever means 25, the lever means 25 including a first adjustable lever 26 operatively interconnected to the selector means 22 and acting as a main range lever for the switch construction 23 in a manner hereinafter described and a second adjustable lever 27 operatively interconnected to the selector means 22 for adjusting the movement differential of the switch construction 23 in a manner hereinafter set forth.

Figure 9:
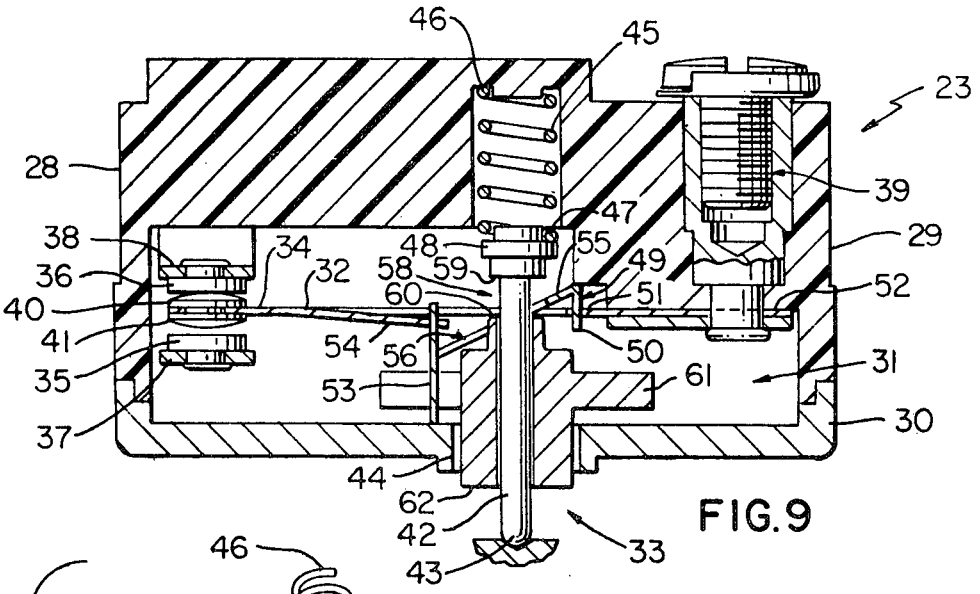
FIG. 9 is a cross-sectional view taken on line 9—9 of FIG. 7.
Figure 10:
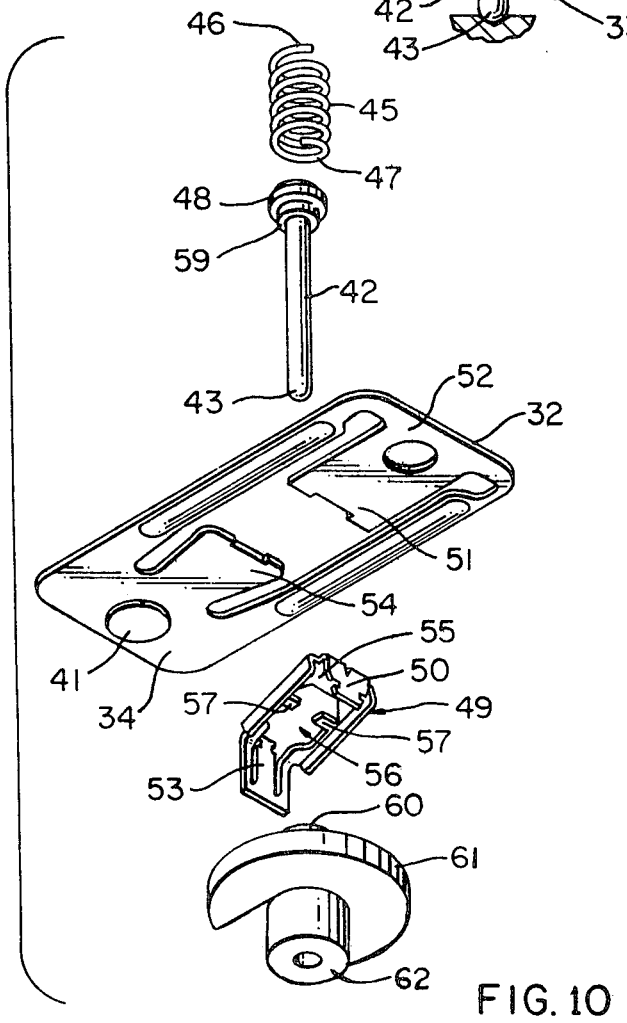
FIG. 10 is an exploded perspective view of certain parts of the electrical switch construction of FIG. 9.

As best illustrated in FIG. 9, the electrical switch construction 23 of this invention is generally of the type set forth in the aforementioned co-pending parent patent application and comprises a housing means 28 formed from a first housing part 29 cooperating with a cover housing part 30 to define a chamber 31 therein containing a snap switch blade 32 adapted to be operated by a actuator means that is generally indicated by the reference numeral 33 to switch a contact carrying portion 34 of the switch blade 32 between a pair of spaced contact stops 35 and 36 respectively electrically interconnected to terminal means 37 and 38, the switch blade 32 being mounted to the housing means in a cantilever manner by its terminal means 39 that is also external to the housing means 28.

In this manner, the terminal 39 is adapted to be electrically interconnected to the terminal 38 of the switch construction 28 when the switch blade portion 34 has its upper contact 40 disposed in electrical contact with the contact 36 as illustrated in FIG. 9. However, when the actuator means 33 is moved inwardly in a manner hereinafter described, the switch blade 32 is snapped from the upper contact 36 to the lower contact 35 whereby a lower contact 41 on the contact carrying portion 34 of the blade 32 is placed in electrical contact with the electrical contact 35 so that the terminal 39 is now electrically interconnected to the terminal 37.

The actuator means 33 of this invention includes an actuator button or plunger 42 that has a part 43 projecting out of an opening 44 in the cover 30 and being urged to its out position by a return compression spring 45 having one end 46 bearing against the housing part 29 and the other end 47 bearing against an enlarged end 48 of the plunger 42.

The actuator means 33 also includes an actuator spring 49 that has one leg 50 pivoted to a part 51 of a rear portion 52 of the blade 32 and another leg 53 interconnected to a tongue part 54 of the forward portion 34 of the blade 32, the legs 50 and 53 of the actuator spring 49 being compressed toward each other when assembled with the blade 32 into the arrangement illustrated in FIG. 9. An intermediate central part 55 of the actuator spring 49 has an opening 56 passing therethrough and receiving the reduced portion of the plunger 42 therethrough whereby a pair of intermediate tongues or parts 57 of the actuator spring 49 are disposed in a lost motion means or air gap 58 of the actuator means 33 that is defined between a shoulder 59 on the end 48 of the plunger 42 and a shoulder 60 on a sleeve 61 telescoped about the plunger 42 and having an end 62 also projecting out of the opening 44 of the cover 30 of the housing 29 as illustrated in FIG. 9 for a purpose hereinafter described. Thus, the actuator spring 49 can move relative to the actuator means 33 as will be apparent hereinafter.

Figure 11:
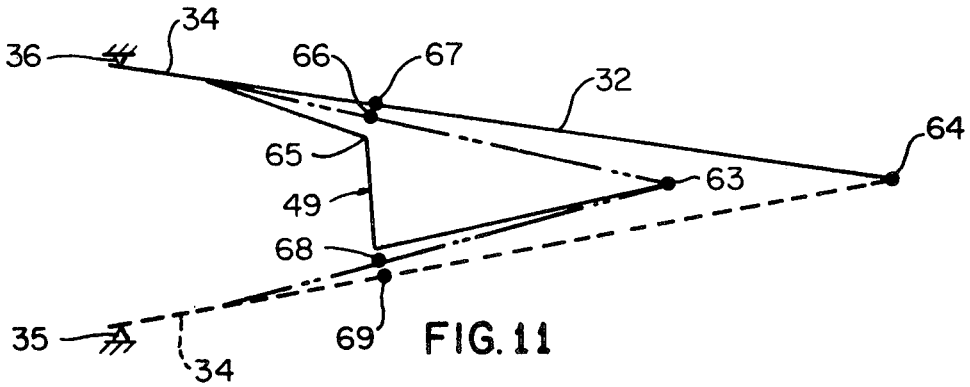
FIG. 11 is a schematic showing of the forces and over-center positions of the movable parts of the switch construction of FIG. 3.

As illustrated schematically in FIG. 11, the pivot point of the actuator spring 49 is indicated by the reference numeral 63 while the pivot point for the switch blade 32 is indicated by the reference number 64 wherein it can be seen that the pivot points 63 and 64 for the acutator spring 49 and switch blade 32 are disposed in a straight line that bisects the air gap between the normally closed contact stop 36 and the normally open contact stop 35 with the pivot points 63 and 64 being separated from each other for a purpose hereinafter described. The tongue 54 of the switch blade 32 is interconnected to the leg 53 of the actuator spring 49 at the reference numeral 65 in FIG. 11.

When the actuator spring 49 is being moved upwardly about its pivot point 63 in FIG. 11 by the shoulder 60 of the sleeve 61 of the actuator means 33 pushing upwardly on the intermediate parts 57 of the actuator spring 49 in opposition to the force of the reset or return spring 45, the point 65 of interconnection of the switch blade tongue 54 and the actuator spring 49 moves upwardly and when the same reaches the point represented by the reference numeral 66, the actuator spring 49 itself snaps over center to cause stored energy in the spring 49 to move the actuator spring 49 rapidly upwardly relative to the actuator sleeve 61 and plunger 42 through the air gap or lost motion means 58 thereof and when the point 65 of the actuator spring 49 reaches the point represented by the reference numeral 67 in FIG. 11, the over center portion for the switch blade 32 is now reached whereby the switch blade 32 snaps over center. When the blade 32 snaps over center through the force of the spring 49, the contact portion 34 thereof snaps rapidly downwardly to place the lower contact 41 thereof against the normally open contact 35 as represented by dash-dotted lines in FIG. 11. Thus, it can be seen that when the actuator spring 49 has the point 65 thereof reach the point 66 so that the stored energy of the actuator spring 49 takes over, the actuator spring 49 still must move the distance between the points 66 and 67 before the switch blade 32 moves over center so that the time when the point 65 on the actuator spring 49 reaches the over center point 66 of the actuator spring 49, the switch blade 32 is maintaining the upper contact 40 thereof in contact with the fixed upper contact 36 with a sustained contact force at this so-called "trip point" of the switch construction 23 for the reason fully advanced in the aforementioned co-pending patent application.

When the actuator means 33 moves outwardly from the tripped position previously described in a manner hereinafter described, so that the force of the return or reset compression spring 45 can move the plunger 42 downwardly, the shoulder 59 on the end 48 of the plunger 42 comes into contact with the intermediate parts 57 of the actuator spring 49 and moves the point 65 of the actuator spring 49 downwardly until the same reaches the point 68 in FIG. 11 whereby the actuator spring 49 now goes over center in the opposite direction and snaps downwardly relative to the actuator plunger 42 through the lost motion means 58 to carry the point 65 to the point 69 whereby the switch blade 32 is now moved over center so that the blade 32 is snapped from the down position back to the up position illustrated in FIG. 9. Thus, it can be seen that a contact force is being sustained at the lower contact 35 at the time that the actuator spring 49 moves over center at the point 68 which is the "trip point" of the switch construction for the reasons and purposes fully advanced in the aforementioned co-pending patent application.

In this manner, it can be seen that the distance of the air gap 58 between the shoulders 59 and 60 of the actuator means 33 determines the movement of the actuator means 33 for causing the switch blade 32 to move between the spaced contact stops 36 and 35.

Therefore, by making the sleeve 51 of the actuator means 33 adjustable relative to the plunger 42 in a manner hereinafter described, the air gap or lost motion means 58 can be adjusted to have the shoulder 60 moved relative to the shoulder 59 a desired distance so that the movement differential of the switch construction 10 of the actuator means 33 can be adjusted without causing any change in the contact forces being sustained at the contacts 35 and 36 for the reasons fully advanced in the aforementioned co-pending parent patent application.

The plunger 42 of the actuator means 33 of the switch construction 23 is controlled by the position of the main lever 26 of the lever arrangement 25 of the control unit 22. In particular, an intermediate part 70 of the lever 26 bears against an end surface 71 of an externally threaded member 72 forming part of the selector means 22 and being threaded in a fixed threaded member 73 carried by the housing means 21 whereby rotation of the threaded member 72 relative to the fixed threaded member 73 will move the end 71, and, thus, the pivot point for the lever 26 relative to the switch construction 23 as illustrated schematically in FIG. 12.

Figure 4:
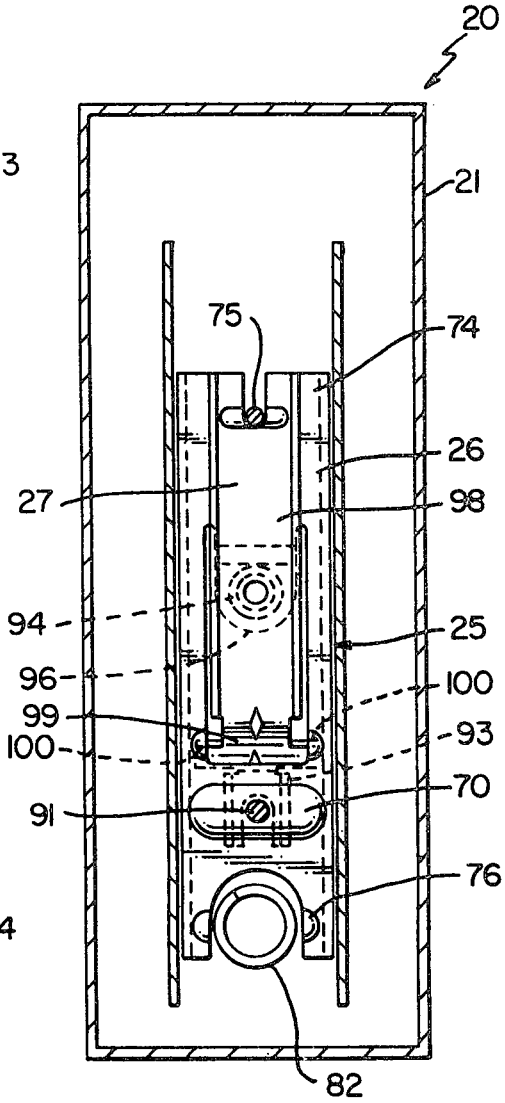
FIG. 4 is a cross-sectional view taken on line 4—4 of FIG. 2.

The main lever 26 has one end 74 thereof carrying an adjusting member 75 for bearing against the projecting portion 43 of the plunger 42 as illustrated in FIG. 2 while the other end 76, FIG. 4, of the lever 26 is adapted to bear against an end member 77 that forms part of a movable wall of a bellows construction 78 that defines part of the condition responsive device 24 as illustrated.

Figure 6:
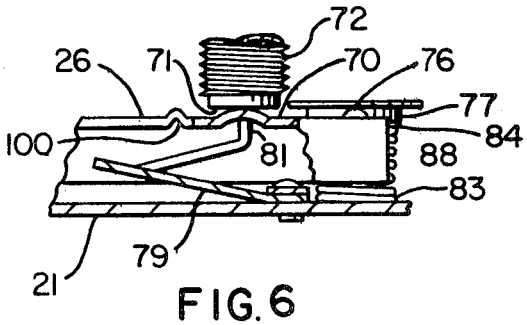
FIG. 6 is a cross-sectional view taken on line 6—6 of FIG. 5.
Figure 8:
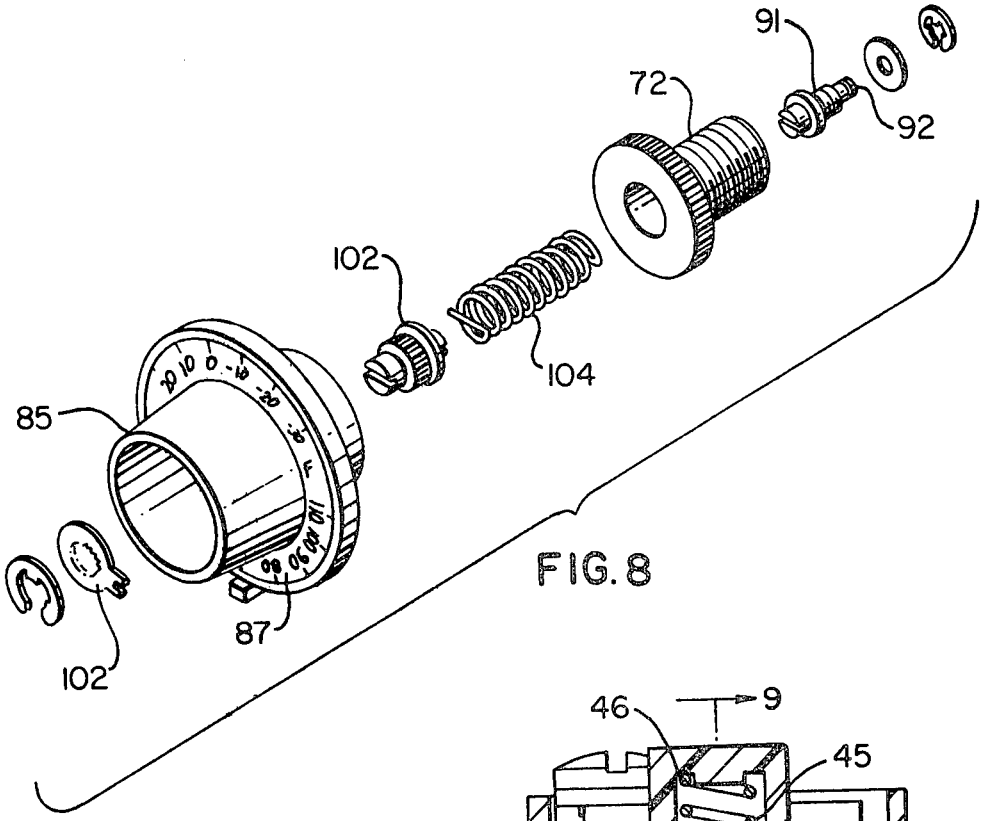
FIG. 8 is an exploded perspective view of certain parts of the selector means of the control unit of FIG. 2.
Figure 7:
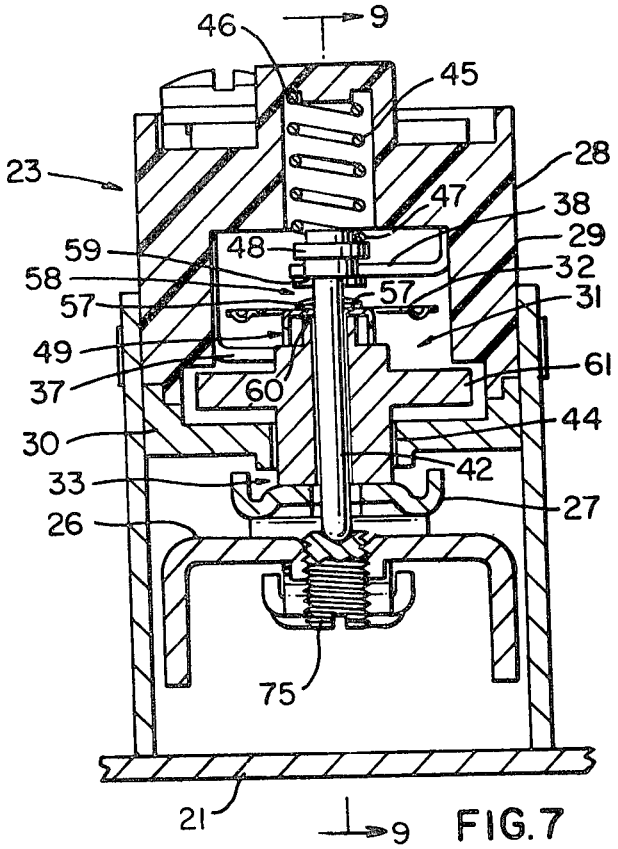
FIG. 7 is an enlarged cross-sectional view taken on line 7—7 of FIG. 2.

As illustrated in FIGS. 2 and 6, a leaf like spring member 78 is fixed to the housing means 21 by a rivet 80 so that a free end 81 of the leaf spring member 79 bears against the intermediate part 70 of the lever 26 to always maintain the intermediate part 70 in engagement with the end 71 of the adjusting member 72 as illustrated.

A compression spring 82 has one end 83 bearing against the housing means 21 and the other end 84 thereof bearing against the end member 77 of the bellows construction 78.

Figure 12:
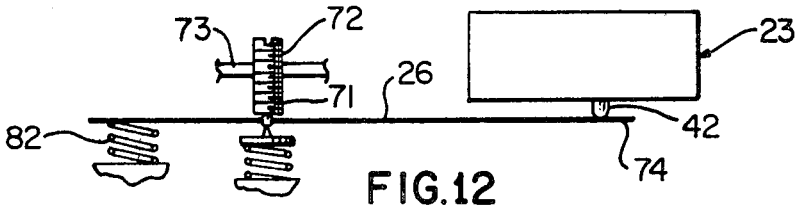
FIGS. 12–14 are respectively schematic views illustrating the theory of operation of the control unit of this invention.

In this manner, the expansion of the bellows construction 78 to the right in FIG. 2 upon sensing an increase in temperature will cause the lever 26 to pivot in a counter clockwise direction about the pivot point 71 for the lever 26 as illustrated in FIG. 2 and schematically in FIG. 12 to thereby cause the end 74 of the lever 26 to operate the actuator means 33 of the switch construction 23 in a direction into the switch construction 23 for a purpose hereinafter described. Conversely, a decrease is sensed temperature causes the bellows construction 78 to collapse under the force of the compression spring 82 and thereby permits the lever 26 to be pivoted about the pivot point 71 in a clockwise direction by the switch return spring 45 so that the end 74 of the lever 26 moves outwardly with the actuator means 33 relative to the switch construction 23. Thus, the return spring 45 moves the actuator means 33 of the switch construction 23 downwardly in FIG. 9 and FIG. 12 for a purpose hereinafter described.

Thus, by rotating the threaded member 72 by an interconnected knob construction 85 of the selector means 22 relative to a fixed indicator means 86, the pivot point 71 for the lever 26 is adjusted as will be apparent hereinafter and will set the cut out temperature for the control unit 20, i.e., will set the temperature which will cause the control unit 20 to move the switch blade 32 away from the lower contact 35 and return the switch blade 32 against the upper contact 36 is illustrated in FIG. 9 whereby in one example of the unit 20 a heat exchanger will have its cooling output effect turned off as the heat exchanger only has its cooling operation turned on in this example when the switch blade 32 is against the lower contact 35.

Conversely, by adjusting the pivot point of the lever 27 in a manner hereinafter described by the selector means 22 in a manner hereinafter described, such adjustment will select the cut in temperature for the unit 22 for causing the switch blade 32 to have its contact portion 34 snapped away from the contact 36 and placed into contact with the lower contact 35 in FIG. 9 so that the heat exchanger will have its cooling output effect turned on by the switch construction 23 until the output temperature effect reaches the cut out temperature setting of the adjusting member 72.

For example, the control knob 85 of the selector means 22 can carry a temperature plate 87 which will be exposed at a cut out 88 in a cover member 89 of the control unit 20 as illustrated in FIG. 1 whereby rotation of the knob 85 will move the dial face 87 relative to a fixed indicator pointer 90 on the cover member 89 to indicate the temperature setting for the control unit 20 to turn off the cooling output temperature effect of the heat exchanger when the output temperature effect thereof reaches a temperature set by the dial face 87 relative to the stationary pointer 90 as will be apparent hereinafter.

Figure 13:
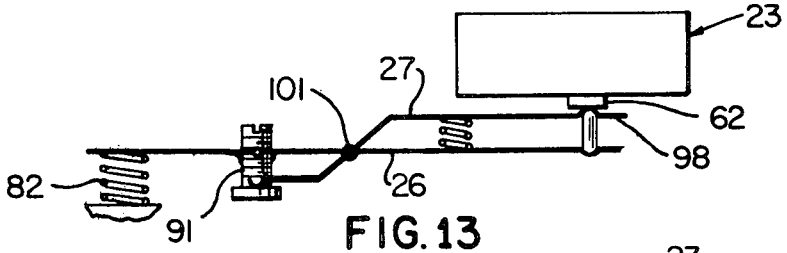
Figure 14:
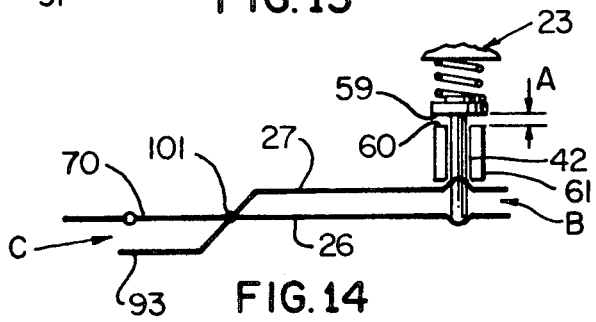

The lever 26 carries a threaded adjusting member 91 at the pivot portion 70 thereof with the threded member 91 having an enlarged end 92 against which a bifurcated end 93 of the second lever 27 is pivoted against by a compression spring 94 having one end 95 bearing against a portion 96 of a lever 26 and the other end 97 thereof bearing against the end 98 of the lever 27 which has an intermediate portion 99 thereof being pivoted on a portion 100 of the lever 26 as illustrated in FIGS. 2 and 4 and schematically represented by the pivot point 101 in FIGS. 13 and 14.

Thus, the position of adjustment of the end 92 of the adjustable member 91 relative to the intermediate part 70 of the first lever 26 determines the distance that the end 98 of the lever 27 will be set from the end 74 of the lever 26 as illustrated in FIGS. 13 and 14. The end 98 of the lever 27 bears against the shoulder 62 of the sleeve 61 which is normally held into contact with the end 98 of the lever 27 by the force of the actuator spring 49 when the actuator spring 49 is in the position illustrated in FIG. 9.

A rotatable adjusting member 102 is carried on a plate-like portion 103 of the adjusting knob 85 and can be rotated relative thereto and through a spring drive 104 provide rotational movement of the threaded member 91 relative to the intermediate part 70 of the lever 26 whereby rotation of the member 102 will set the adjustment of the adjusting member 91 relative to the lever 26 and, thus, the adjustment of the end 98 of the lever 27 relative to the end 74 of the lever 26.

As illustrated in FIG. 3, the dial plate means 87 has an inner scale 105 thereon against which a pointer part 106 of the rotatable member 102 can be positioned to set the cut in temperature of the control unit 20, such movement of the member 102 relative to the dial plate means 87 of the control knob 85 is independent of the adjusting member 72 of the control knob or selector means 22 and the adjustment of the control knob 85 for the adjusting member 72 is independent of the position of the member 102.

Thus, when the control knob 85 is rotated to set the cut out temperature, and, thus, the pivot point 71 for the first lever 26 of the lever arrangement 25, the member 102 does not move and likewise when the member 102 is rotated to set the position of the end 93 of the lever 27 relative to the intermediate part 70 of the lever 26, the member 72 does not move.

It can be seen in FIG. 14 that the gap A between the surfaces 59 and 60 of the plunger 42 and sleeve 61 controls the movement of the switch construction 23 actuator spring 49. As this gap A is varied, the movement differential of the switch construction 23 is varied and likewise the temperature differential of the control unit 20 changes. Gap A is directly related to gap B in FIG. 14 through the adjustment sleeve 61. Gap B is altered through the turning of the differential adjusting screw 91 which changes the gap C in FIG. 14 which is the distance between the end 93 of the lever 27 and the intermediate part 70 of the lever 26. The differential adjusting screw 91 is grounded to the pivot 70 of the main lever 26 so that a coaxial range-differential adjustment is possible.

In one embodiment of the control unit 20, the power element 78, switch lever ratio is 1:3.625 and this gives a minimum temperature differential of 1.85° F. with a switch movement differential of 0.004 of an inch. If gap C is opened approximately 0.015 of an inch, opening gap B and gap A approximately 0.072 of an inch, the switch movement differential becomes approximately 0.076 of an inch and the control temperature differential is approximately 35° F. Accordingly, there is no lost motion or gap variation during the control's functioning as with the control unit of the aforementioned U.S. Pat. No. 3,952,611 as the gap changes in the control unit 20 of this invention only occurs during differential changes.

Accordingly, it can be seen that the control unit 20 of this invention can be formed with a unique lever arrangement 25 to permit independent adjustments of the cut in and cut out temperatures thereof whereby the control unit 20 will operate in a manner now to be described.

When the operator desires to set the control unit 20 for turning on a cooling heat exchange unit when the temperature reaches 80 degrees and for turning off the heat exchange unit when the temperature reaches 70° F., the operator can set the selector means 22 for when the control unit 20 is to turn off the output cooling effect of the heat exchanger by rotating the control knob 85 relative to the fixed pointer 90 in FIG. 1 to position the desired temperature on the outer scale of the plate 87 relative to the pointer 90 so that the unit 20 will turn off the head exchanger when the temperature is lowered to 70° F. Such rotation of the knob 85 rotates the adjusting member 72 and, thus, positions the pivot point 71 for the lever 26. The operator then removes the cover of the control knob to reach the adjusting member 102. The operator adjusts the member 102 relative to the inner scale 105 until the pointer 106 is set for 80 degrees whereby such adjustment of the member 102 adjusts the threaded member 91 relative to the intermediate part 70 of the lever 26 so that the gap A between the shoulders 60 and 59 of the sleeve 61 and plunger 42 of the actuator means 33 of the switch construction 23 is adjusted.

With the members 102 and 85 of the selector means 22 so adjusted and as the temperature being sensed by the power element 78 increases to the cut in temperature of 80° F., the same moves the movable wall 77 to the right in FIG. 2 and thereby causes the two levers 26 and 27 to pivot in unison in a counter clockwise direction about the pivot point 71 for the lever 26 so that the shoulder 60 on the sleeve 61 moves the actuator spring 49 upwardly in FIG. 9 to such a position that the same snaps over center as illustrated in FIG. 11 to cause the switch blade 32 to subsequently snap over center and move the contact portion 34 thereof downwardly away from the upper contact 36 and into contact with the lower contact 35 to thereby turn on the heat exchange unit which now begins to cool the building, etc. where the control unit 20 is located.

With the heat exchange unit now turned on, the temperature being sensed by the device 24 now decreases and when the same has descreased to 70° F. to cause the bellows 78 to collapse through the spring 82 and thereby permit the levers 26 and 27 to pivot in unison in a clockwise direction about the pivot point 71 a distance sufficient so that the return spring 45 has moved the shoulder 59 of the plunger 42 downwardly in FIG. 9 a sufficient distance to cause the actuator spring 49 to snap over center as represented in FIG. 11 and cause the switch blade 32 to snap over center back to the position illustrated in FIG. 9, the heat exchange unit is turned off to terminate the output cooling effect. Thus, it can be seen that the control unit 20 will cycle the heat exchange unit on and off at the two temperatures selected by the selector means 22 to tend to maintain the temperature effect between the cut in and cut out temperatures selected thereby.

Accordingly, it can be seen that the control unit 20 of this invention provides separate and independent adjustments for the cut in and cut out temperature settings thereof and such adjustments are permitted by changing the movement differential of the switch construction 23 as previously described.

For example, adjustment of the lever 26 by the member 72 sets the temperature for when the shoulder 59 of the plunger 42 will cause the actuator spring 49 to move the switch blade 32 from the lower contact 35 to against the upper contact 36. Adjustment of the lever 27 by the member 91 sets the temperature for when the shoulder 60 of the sleeve 61 will cause the actuator spring 49 to move the switch blade 32 from the upper contact 36 to against the lower contact 35 whereby the switch construction 23 can control any desired device, whether the same be a cooling heat exchange unit, a heating heat exchange unit, etc.

Accordingly, it can be seen that this invention not only provides an improved control unit and method of making the same, but also this invention provides an improved electrical switch construction and method of making the same.

While the forms and methods of this invention, now preferred, have been illustrated and described as required by the Patent Statute, it is to be understood that other forms and method steps can be utilized and still fall within the scope of the appended claims.

What is claimed is:

1. A method of making an electrical switch construction having a housing means carrying a pair of spaced content stops and a snap switch blade having a contact portion for being snapped between said stops when said blade is moved overcenter, and a movable actuator means carried by said housing means for moving said blade overcenter in one direction when said actuator means is moved in one direction thereof and for moving said blade overcenter in the opposite direction when said actuator means is moved in the opposite direction thereof, said method comprising the steps of forming said actuator means to be adjustable for adjusting the movement differential of said actuator means without adjusting the air gap between said contact stops, forming said actuator means to extend out of said housing means to thereby be accessible for adjustment external to said housing means, forming part of said actuator means with an actuator plunger, forming part of said actuator means with an actuator spring that is moved by movement of said actuator plunger, operatively interconnecting said actuator spring to said blade to move said blade as said actuator spring is moved, forming said actuator means with an adjustable gap defined by a pair of spaced shoulders on said actuator means that are adapted to respectively engage said actuator spring, and forming part of said actuator means from a sleeve movably carried by said housing means and being operatively associated with said plunger.

2. A method of making an electrical switch construction as set forth in claim 1 and including the steps of forming said plunger to have a stop part thereon that defines one of said shoulders, and forming said sleeve to define the other of said shoulders whereby said sleeve and said stop part define said gap therebetween that controls the movement differential of said actuator means.

3. A method of making an electrical switch construction as set forth in claim 2 and including the steps of forming said sleeve to comprise a tubular member having opposed ends, and loosely telescoping said tubular member on said plunger so that one opposed end thereof projects out of said housing means and the other opposed end thereof defines said other shoulder.

* * * * *